US012560328B2

(12) United States Patent
Baldi et al.

(10) Patent No.: US 12,560,328 B2
(45) Date of Patent: Feb. 24, 2026

(54) FUEL NOZZLE FOR A GAS TURBINE, COMBUSTOR INCLUDING THE FUEL NOZZLE, AND GAS TURBINE

(71) Applicant: NUOVO PIGNONE TECNOLOGIE-S.R.L., Florence (IT)

(72) Inventors: Matteo Baldi, Florence (IT); Martina Malarco, Florence (IT); Egidio Pucci, Florence (IT); Leonardo Fratini, Sondrio (IT)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 0 days.

(21) Appl. No.: 18/834,516

(22) PCT Filed: Feb. 2, 2023

(86) PCT No.: PCT/EP2023/025048

§ 371 (c)(1),
(2) Date: Jul. 30, 2024

(87) PCT Pub. No.: WO2023/147943

PCT Pub. Date: Aug. 10, 2023

(65) Prior Publication Data

US 2025/0109855 A1 Apr. 3, 2025

(30) Foreign Application Priority Data

Feb. 3, 2022 (IT) ..... 102022000001943

(51) Int. Cl.
*F23R 3/28* (2006.01)
*F23R 3/34* (2006.01)

(52) U.S. Cl.
CPC ..... *F23R 3/286* (2013.01); *F23R 3/343* (2013.01)

(58) Field of Classification Search
CPC .. F23R 3/286; F23R 3/28; F23R 3/283; F23R 3/34; F23R 3/343; F23R 3/346; F23R 3/36
See application file for complete search history.

(56) References Cited

U.S. PATENT DOCUMENTS 4,850,194 A 7/1989 Fuglistaller et al.
5,101,633 A 4/1992 Keller et al.
(Continued)

FOREIGN PATENT DOCUMENTS

CN 102022753 A 4/2011
DE 10 2015 204594 A1 9/2016
(Continued)

*Primary Examiner* — William H Rodriguez
(74) *Attorney, Agent, or Firm* — Paul Frank + Collins P.C.

(57) ABSTRACT

A fuel nozzle comprising a stem and a first fuel feed channel extending inside the stem from an inlet end positioned at a proximal end of the stem to a first fuel inlet plenum. The fuel nozzle further comprises a first set of fuel injectors fluidly coupled to the first fuel inlet plenum. The fuel nozzle further includes a second fuel feed channel extending inside the stem from an inlet end, positioned at the proximal end of the stem, to a second fuel inlet plenum. A second set of fuel injectors are fluidly coupled to the second fuel inlet plenum. Each fuel injector comprises a centerbody and an outer sleeve surrounding the centerbody and extending along the axis of the centerbody. An annular premix chamber is provided between each outer sleeve and the respective centerbody.

20 Claims, 13 Drawing Sheets

(56) References Cited

U.S. PATENT DOCUMENTS

| | | | |
|---|---|---|---|
| 5,319,923 | A | 6/1994 | Leonard et al. |
| 5,372,008 | A | 12/1994 | Sood |
| 5,487,659 | A | 1/1996 | Eroglu et al. |
| 6,755,024 | B1 | 6/2004 | Mao et al. |
| 7,610,759 | B2 | 11/2009 | Yoshida et al. |
| 9,568,197 | B2 | 2/2017 | Ols et al. |
| 9,677,505 | B2 | 6/2017 | Savary et al. |
| 10,295,190 | B2 | 5/2019 | Boardman et al. |
| 2006/0154192 | A1 | 7/2006 | Flohr et al. |
| 2008/0104961 | A1 | 5/2008 | Bunker |
| 2009/0165435 | A1 | 7/2009 | Koranek |
| 2012/0094239 | A1 | 4/2012 | Miura et al. |
| 2012/0208137 | A1 | 8/2012 | Kirzhner |
| 2014/0116384 | A1 | 5/2014 | Savary et al. |
| 2014/0331678 | A1 | 11/2014 | Cramer |
| 2015/0323187 | A1 | 11/2015 | Gomez Del Campo |
| 2017/0074521 | A1 | 3/2017 | Horikawa et al. |
| 2017/0082291 | A1 | 3/2017 | Horikawa et al. |
| 2017/0321609 | A1 | 11/2017 | Ogata et al. |
| 2018/0128490 | A1 | 5/2018 | Boardman et al. |
| 2018/0128491 | A1 | 5/2018 | Boardman et al. |
| 2018/0128492 | A1 | 5/2018 | Boardman et al. |
| 2019/0032561 | A1 | 1/2019 | Stoia et al. |
| 2020/0158343 | A1* | 5/2020 | Boardman ..... F23R 3/18 |
| 2020/0173662 | A1 | 6/2020 | Boehm et al. |
| 2020/0224876 | A1 | 7/2020 | Greenfield et al. |
| 2020/0263873 | A1* | 8/2020 | Boardman ..... F02C 7/22 |
| 2022/0357038 | A1* | 11/2022 | Boardman ..... F23R 3/286 |
| 2023/0003385 | A1* | 1/2023 | Naik ..... F23R 3/04 |
| 2024/0240793 | A1* | 7/2024 | Pucci ..... F23R 3/286 |

FOREIGN PATENT DOCUMENTS

| | | | |
|---|---|---|---|
| JP | S63161317 | A | 7/1988 |
| JP | H02293510 | A | 12/1990 |
| JP | H0587340 | A | 4/1993 |
| JP | 2014517250 | A | 7/2014 |
| JP | 2016090141 | A | 5/2016 |
| RU | 2506499 | C2 | 2/2014 |
| WO | 2007113130 | A1 | 10/2007 |
| WO | 2014204449 | A1 | 12/2014 |

* cited by examiner

FUEL NOZZLE FOR A GAS TURBINE, COMBUSTOR INCLUDING THE FUEL NOZZLE, AND GAS TURBINE

TECHNICAL FIELD

The subject matter disclosed herein generally relates to gas turbine engines. More particularly, the disclosure concerns a pre-mixing fuel nozzle for gas turbine engine combustors, as well as to gas turbine engine combustors including said pre-mixing fuels.

BACKGROUND ART

Gas turbine engines, for both aircraft and industrial applications, include at least one combustor in which fuel, either in gaseous or liquid form, is mixed with a compressed air stream and combusted to generate a flow of hot, pressurized combustion gas. The combustion gas is expanded in a turbine including one or more turbine stages to generate mechanical power. Part of the mechanical power generated by the turbine is used to drive the compressor of the gas turbine engine and to support continuous supply of combustion air to the combustor. The remaining available power is used to either to drive a load, such as an electric generator or a compressor, or to generate a thrust for aircraft propulsion.

The combustor includes a combustion chamber and a plurality of fuel nozzles, which feed a liquid or gaseous fuel into the stream of compressed air from the air compressor to obtain a mixture of combustion air and fuel. At start-up, the mixture is ignited to burn the fuel. By continuing feed of compressed air and fuel to the combustor, the combustion process is maintained to generate a continuous flow of compressed, hot combustion gas to operate the turbine.

Control of the flame in the combustor is one of the critical aspects of fuel nozzle design. One of the aims of nozzle design is reduction of noxious emissions, such as nitrogen oxides (NOx), carbon monoxide (CO) and unburned hydrocarbons (CxHy). Further points of concern are life-time requirements, in terms of thermal cycles which the burner can withstand prior to replacement, as well as the control of thermally induced deformations.

An improved fuel nozzle design aimed at addressing the above concerns would be welcomed in the art.

SUMMARY

According to an aspect, disclosed herein is a fuel nozzle for a gas turbine, including a stem and a plurality of fuel injectors. The fuel nozzle includes a first fuel feed channel extending inside the stem from an inlet end, positioned at a proximal end of the stem, to a first fuel inlet plenum. A first set of fuel injectors are fluidly coupled to the first fuel inlet plenum and project at an angle from the stem. The fuel nozzle further includes a second fuel feed channel extending inside the stem, from an inlet end, positioned at the proximal end of the stem, to a second fuel inlet plenum. A second set of fuel injectors are fluidly coupled to the second fuel inlet plenum and projecting at an angle from the stem.

In embodiments disclosed herein, each fuel injector includes a centerbody extending along a longitudinal axis from the respective fuel inlet plenum to a distal end of the centerbody. An outer sleeve surrounds each centerbody and extends along the axis of the centerbody. An annular premix chamber is formed between each outer sleeve and the respective centerbody. At least one air inlet port extends through each outer sleeve, and at least one fuel conduit in each centerbody is in fluid communication with the respective fuel inlet plenum and the respective annular premix chamber.

The fuel nozzle including the above parts is manufactured as a single monolithic body or block, preferably by additive manufacturing, which allows complex shapes of the various components and elements to be manufactured with limited design constraints.

According to another aspect, disclosed herein is a combustor including a plurality of fuel nozzles as outlined above, as well as a gas turbine engine including the above-mentioned combustor.

Further features and embodiments will be described in greater detail in the following description, reference being made to the enclosed drawings, and are set out in the appended claims.

BRIEF DESCRIPTION OF THE DRAWINGS

Reference is now made briefly to the accompanying drawings, in which.

DETAILED DESCRIPTION

Embodiments of the invention are suitable for all types of gas turbine engines, regardless of the end use application. Fuel injectors disclosed herein can be used in aeroderivative gas turbines, as well as industrial, heavy duty gas turbines. In the following description reference will be made to a gas turbine for mechanical drive, but those skilled in the art will understand that the fuel injectors of the present disclosure can be used also in gas turbines for electric generation, as well as for air propulsion.

While in the following description reference is made specifically to combustors including an annular combustion chamber, it shall be understood that fuel injectors and fuel nozzles including features of the present disclosure can be used also in other kinds of combustors, including can combustion chambers or tubo-annular combustion chambers, for instance.

Figure 1:
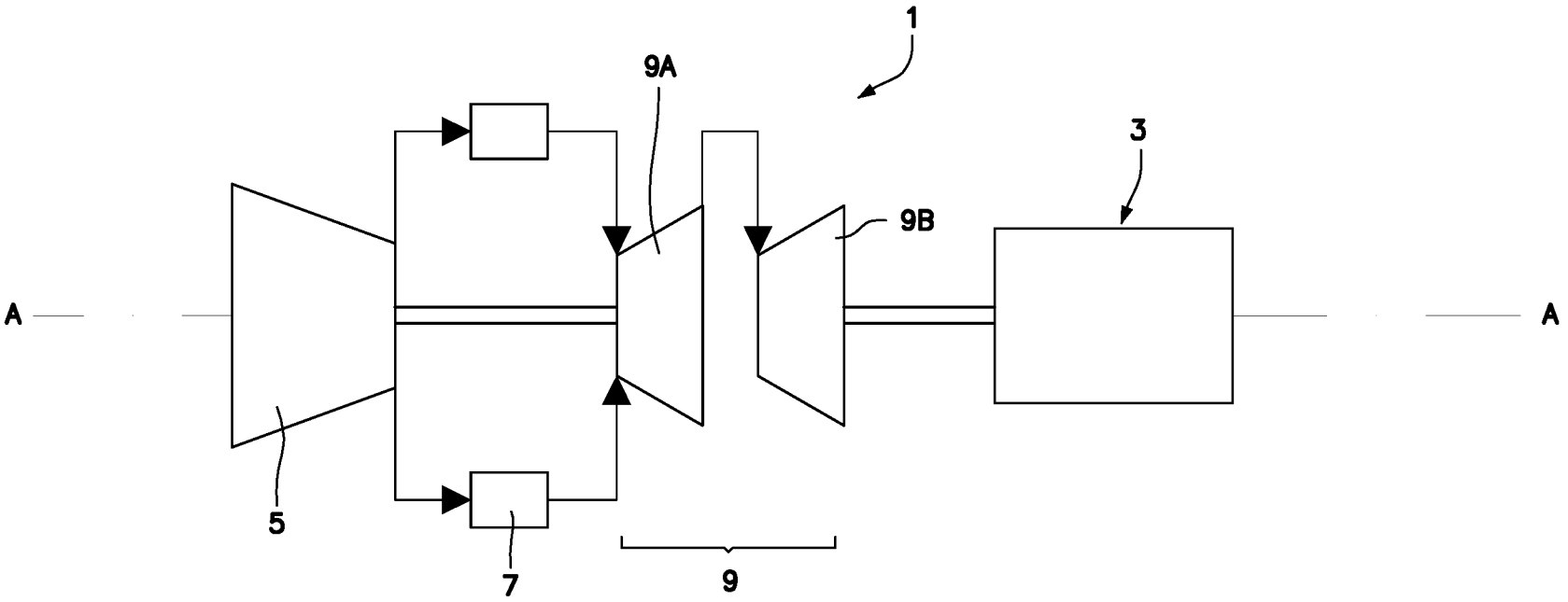
FIG. 1 is a schematic of a gas turbine engine adapted for use in various useful applications, including industrial applications.

Turning now to the drawings, FIG. 1 shows a schematic of a gas turbine engine 1 that is configured for use in various applications, including by way of example, and not limitation, industrial or power generation applications, e.g. for driving a load 3. The load 3 may include a compressor or a compressor train, e.g. in one example, a refrigerant compressor, of a type that could be used in a plant for the production of liquefied natural gas, or in another example, a gas compressor in a gas pipeline. In other embodiments, when the gas turbine engine is used for power generation pur-poses, the load may be an electric generator. Combinations of electric generators and compressors, or other driven machines, are not excluded.

The gas turbine engine 1 includes an air compressor 5, a combustor 7 and a turbine section 9. By way of example only, in FIG. 1 the turbine section 9 comprises a high-pressure turbine 9A and a low-pressure turbine 9B. In embodiments, the high-pressure turbine 9A is mechanically coupled to the air compressor 5 to rotate the air compressor 5. The low-pressure turbine 9B is drivingly coupled to the load 3 and pro-vides power to drive the load 3.

The exemplary gas turbine engine of FIG. 1 is therefore a two-shaft turbine. However, fuel injectors of the present disclosure can be used with advantage also in other kinds of gas turbines, such as single-shaft gas turbines, or gas turbines with three shafts, for instance.

Figure 2:
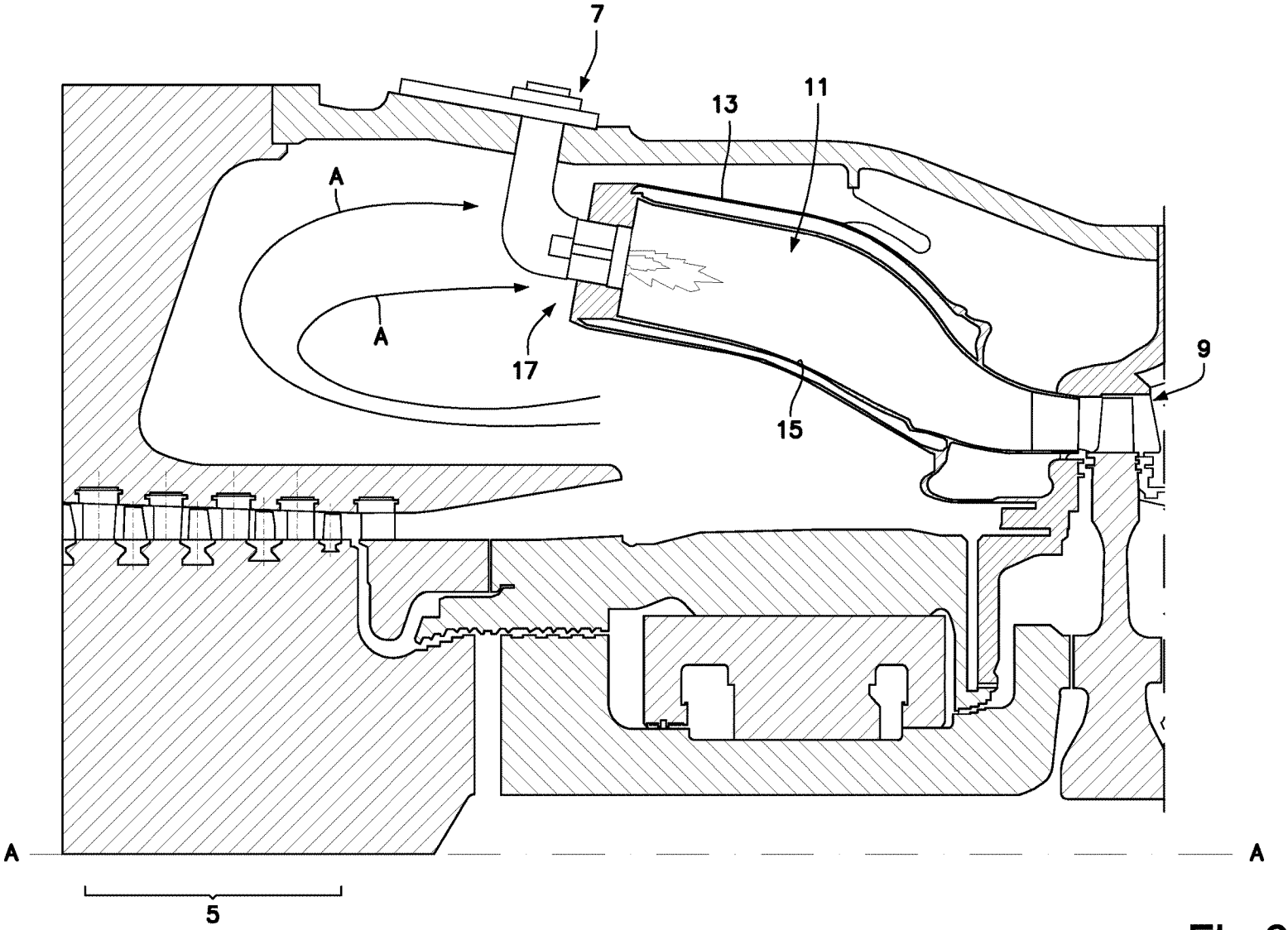
FIG. 2 is a schematic section of a combustor having a plurality of fuel nozzles and an annular combustion chamber, for a gas turbine engine.

According to some embodiments, the combustor 7 comprises an annular combustion chamber 11, as schematically shown in FIG. 2. The combustion chamber 11 comprises an outer liner 13 and an inner liner 15. The outer liner 13 and the inner liner 15 are coaxial to one another and coaxial to the rotation axis A-A of the gas turbine engine 3. The combustion chamber 11 extends in an upstream-downstream direction from the air compressor 5 to the turbine section 9. A plurality of fuel nozzles 17 are arranged in the upstream region of the combustor 7.

Figure 3:
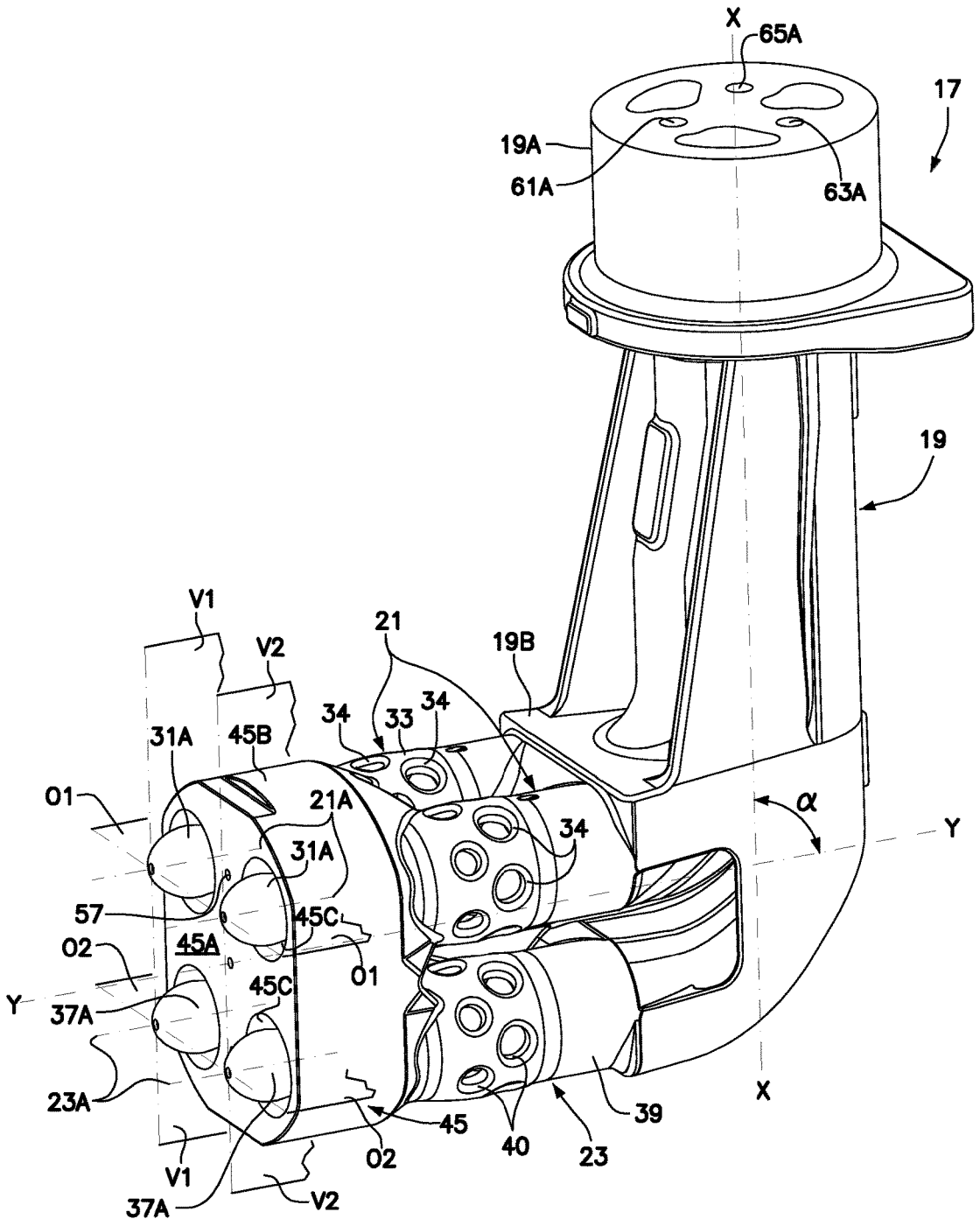
FIG. 3 is an axonometric view of a fuel nozzle according to embodiments disclosed herein.
Figure 4:
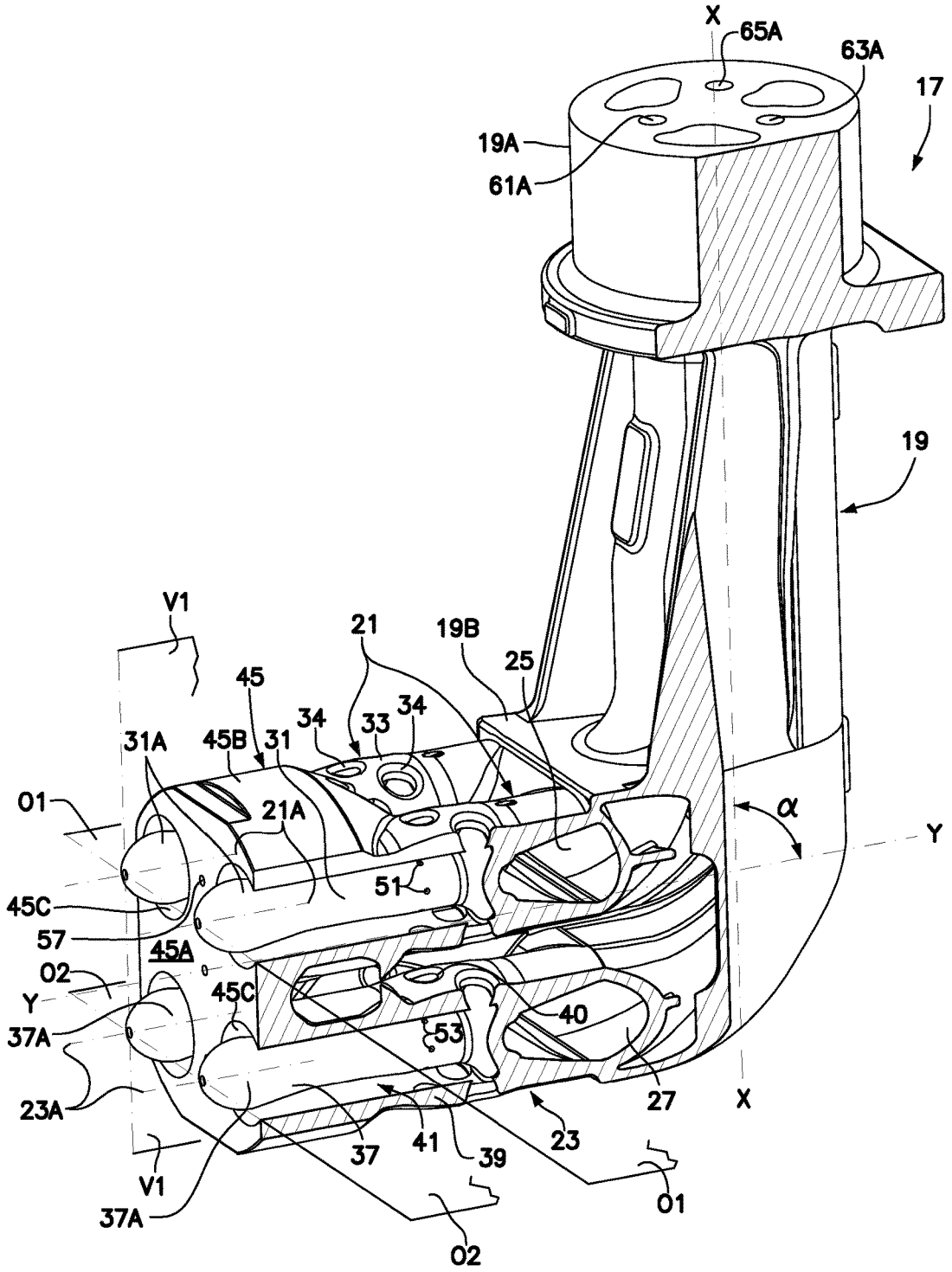
FIG. 4 is a sectional axonometric view of the fuel nozzle of FIG. 3.
Figure 5:
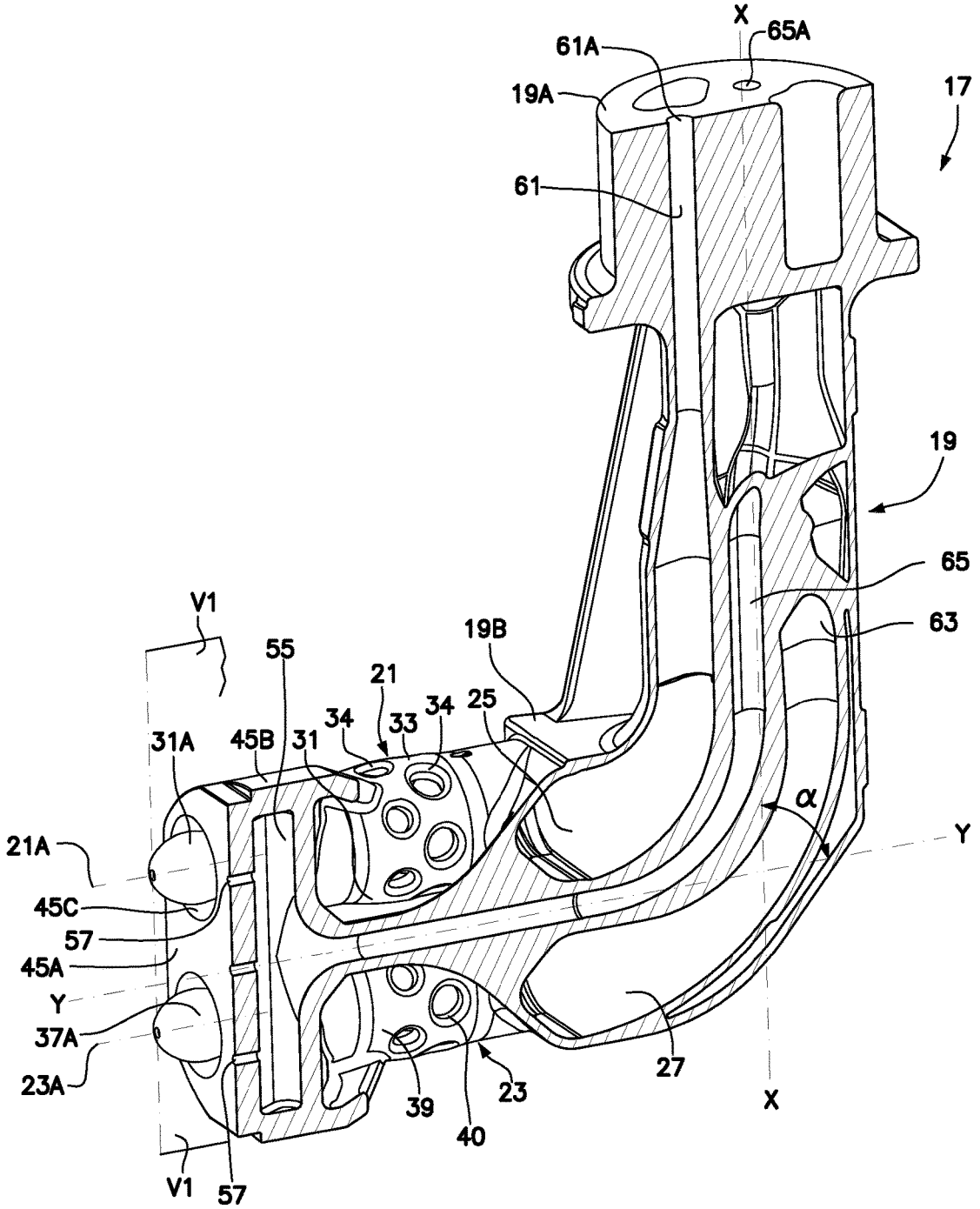
FIG. 5 is a further sectional axonometric view of the fuel nozzle of FIG. 3.
Figure 6A:
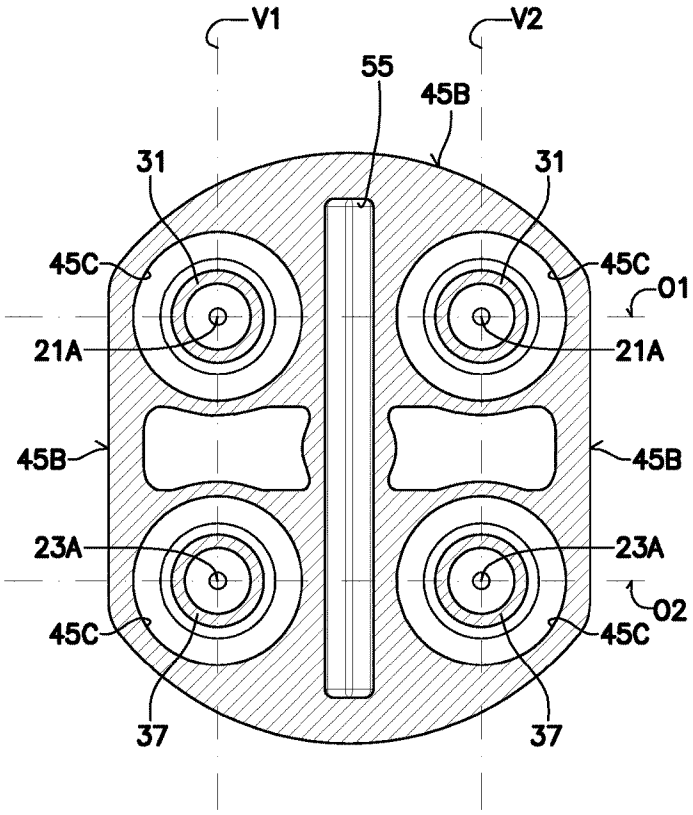
FIG. 6A is a sectional view according to line A-A of FIG. 6.
Figure 6:
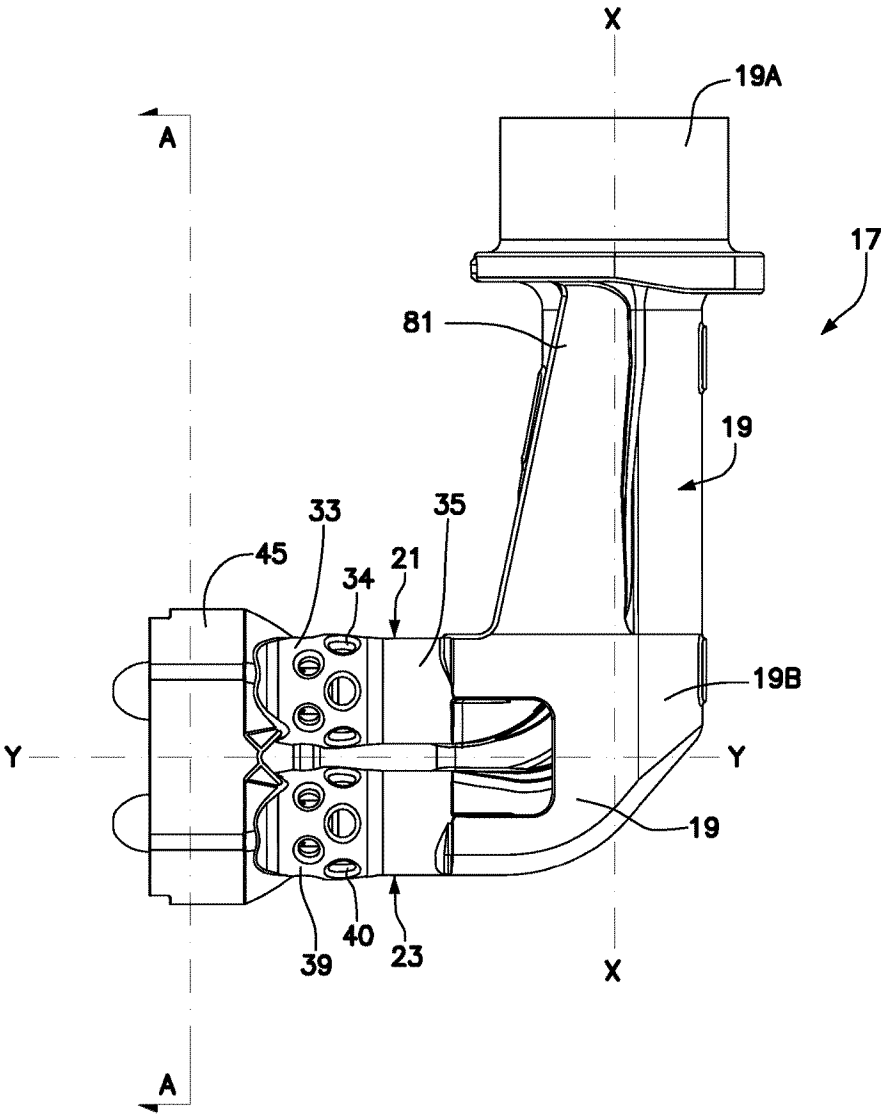
FIG. 6 is a side view the fuel nozzle.

One fuel nozzle 17 is shown in isolation in FIG. 3. FIGS. 4 and 5 show similar axonometric views of the fuel nozzle 17 with parts removed according to a vertical sectional plane. The following pairs of FIGS. 6, 6A show a side view of the fuel nozzle and a sectional view according to line A-A of FIG. 6.

Figure 7:
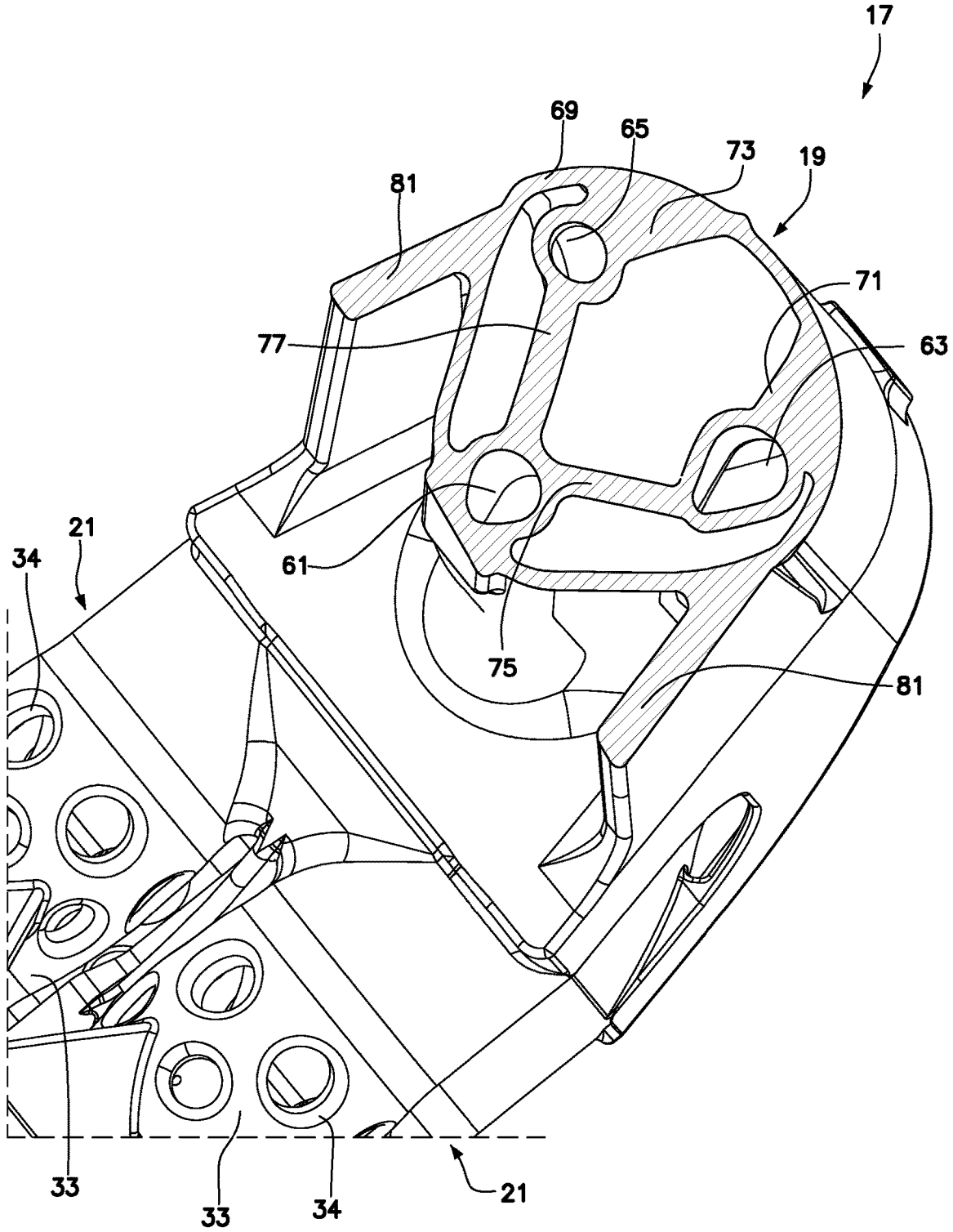
FIGS. 7, 8 and 9 are partial axonometric sectional views of the fuel nozzle along plane orthogonal to the axis of the stem of the nozzle in different positions along the longitudinal extension of the stem.
Figure 8:
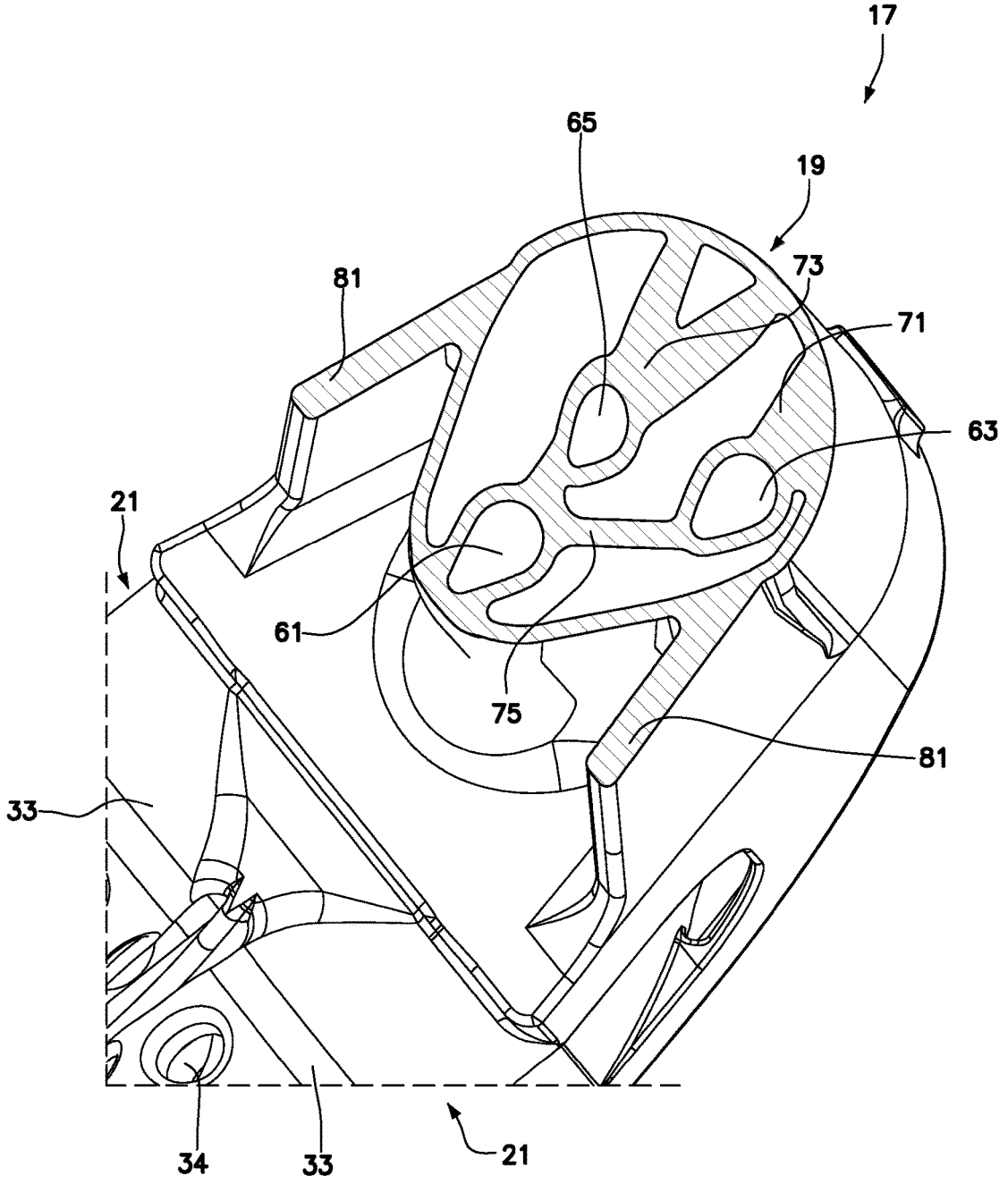
Figure 9:
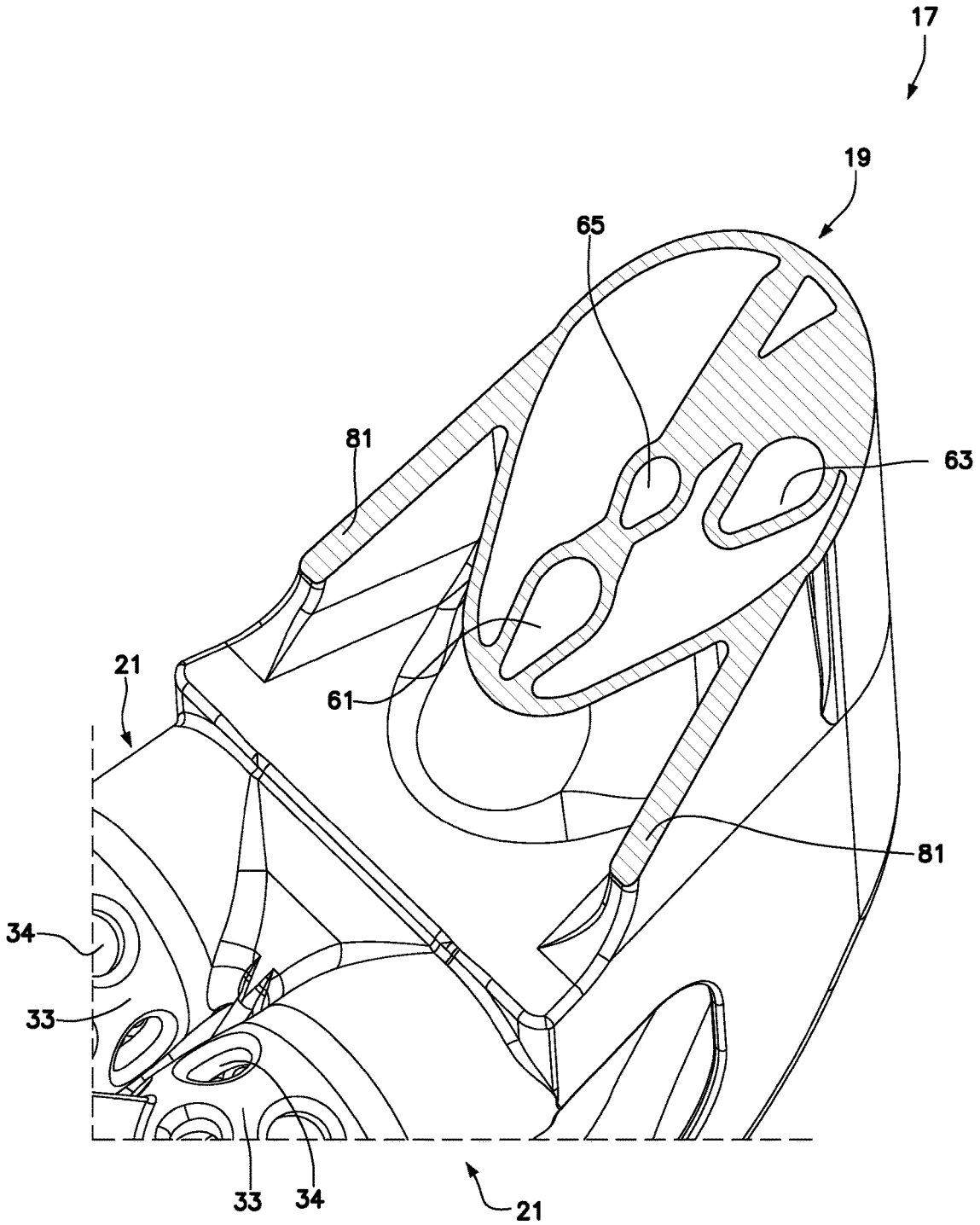
Figure 11:
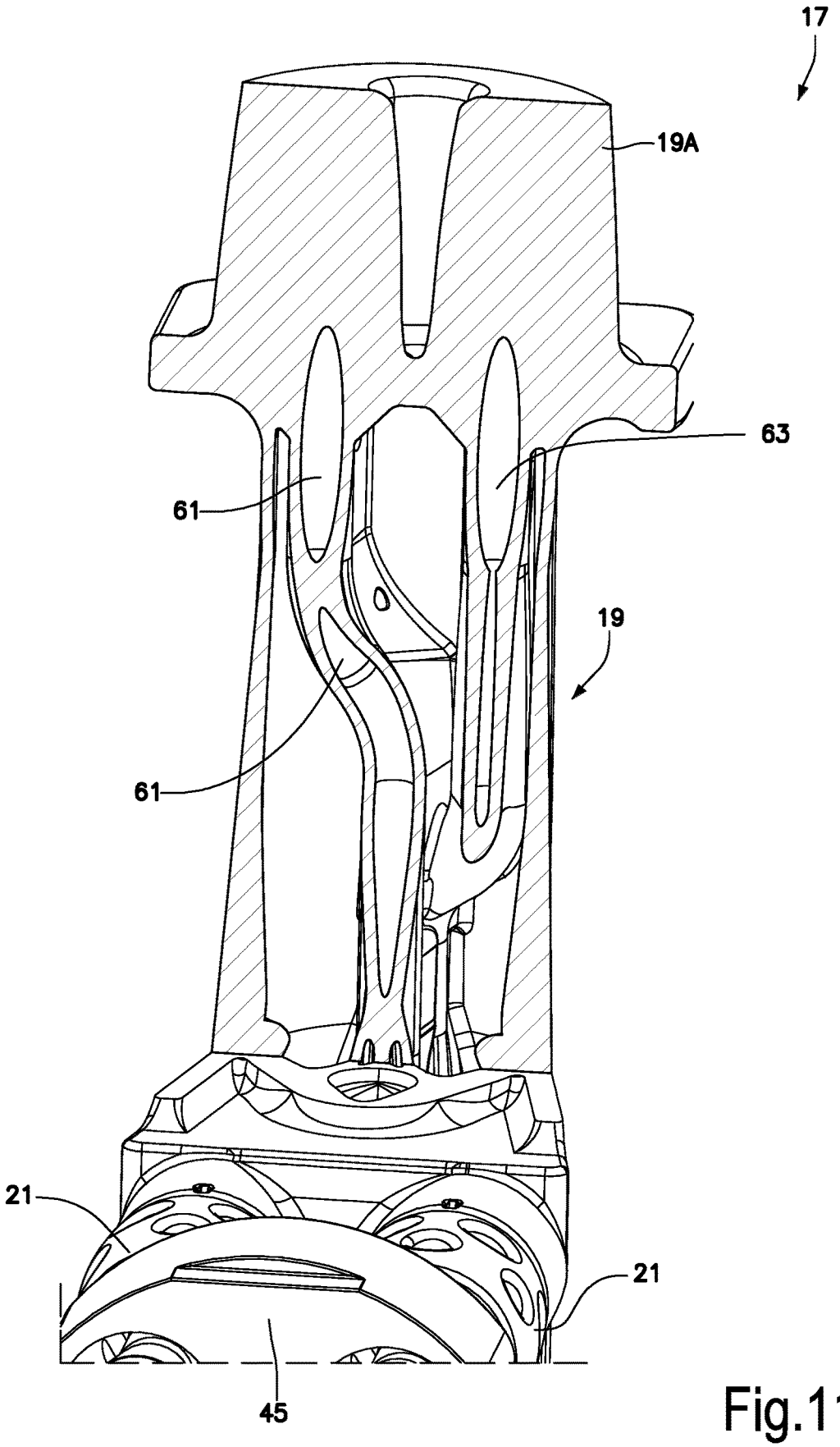
FIGS. 11, 12 and 13 are partial axonometric sectional views of the nozzle according to planes parallel to the longitudinal axis of the stem of the nozzle.
Figure 12:
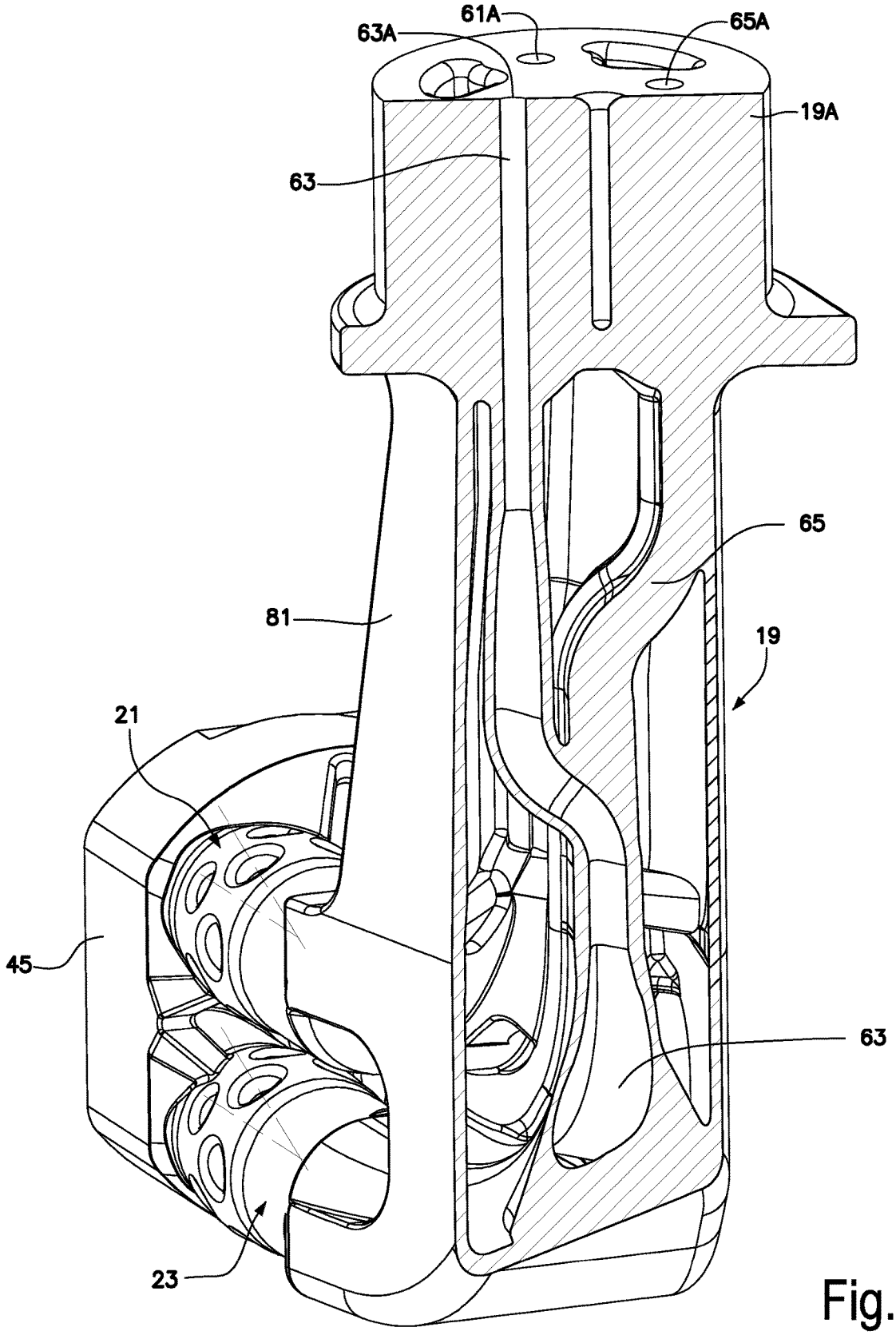
Figure 13:
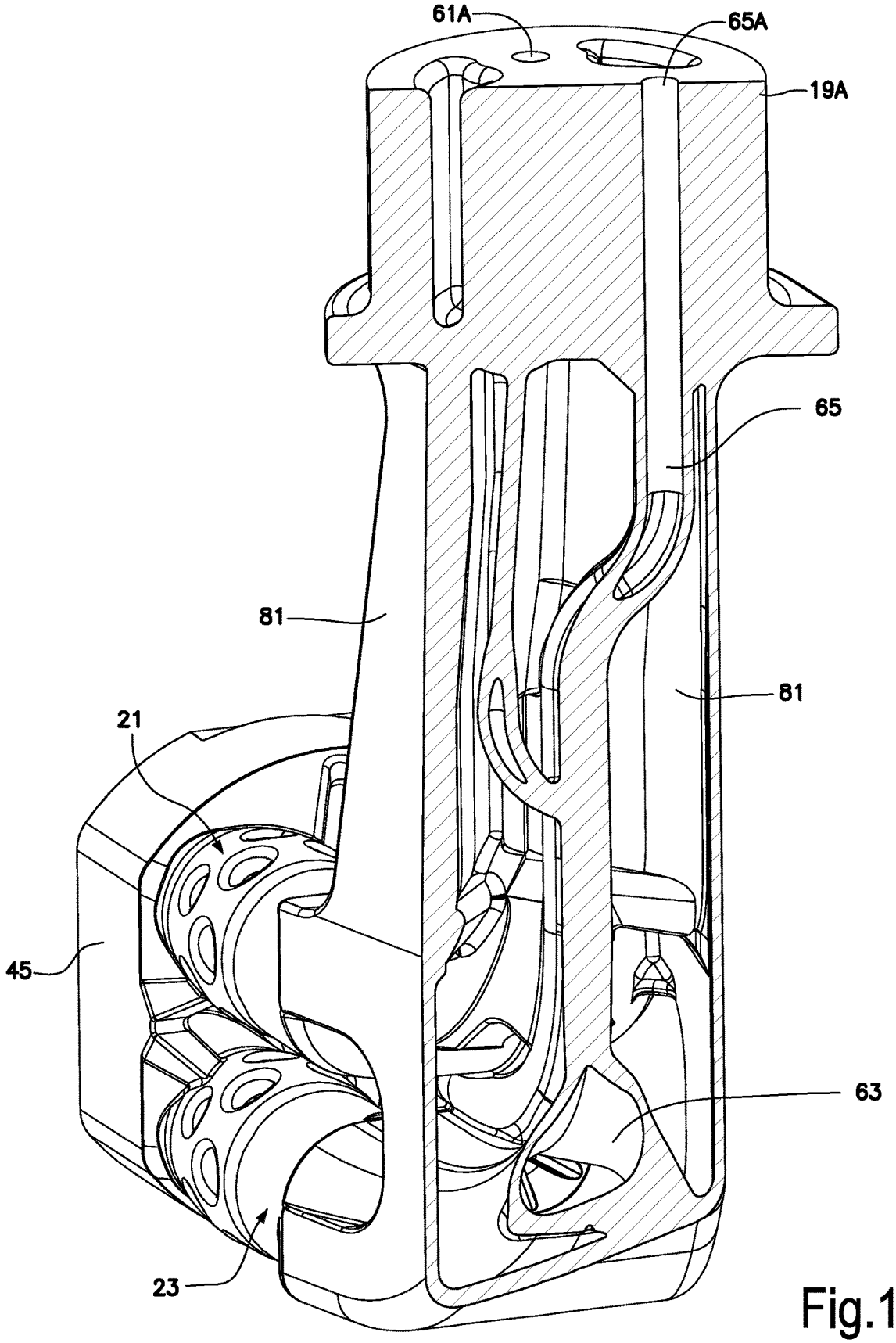

For a better understanding of the shape and development of the plenums and of the channels extending along the stem of the nozzle, FIGS. 7, 8 and 9 show axonometric sectional views of the stem taken along sectional planes orthogonal to the stem axis at variable distance from the proximal end of the stem. Moreover, FIGS. 11, 12 and 13 show axonometric sectional views taken along sectional planes parallel to the stem axis and orthogonal to the axes of the fuel injectors as will be described in greater detail below.

The fuel nozzle 17 comprises a first portion extending along a direction X-X (see FIGS. 3 and 5), which will be referred to herein after as "stem" and labeled 19. The fuel nozzle 17 further includes a second portion extending along a direction Y-Y, which includes a plurality of fuel injectors 21, 23 extending along the direction Y-Y. The directions X-X and Y-Y are at an angle to one another, i.e., the fuel injectors extend in a direction Y-Y which is inclined by an angle $\alpha$ with respect to the longitudinal axis (direction X-X) of the stem 19. The angle $\alpha$ is smaller than 180° and can be comprised, for instance, between 150° and 60°, preferably between 120° and 80°, more preferably between 100° and 80°. For instance, as show in the exemplary embodiment, the direction Y-Y and X-X are at right angle.

In embodiments disclosed herein, the fuel nozzle includes a plurality of fuel injectors. In some embodiments the fuel nozzle includes four fuel injectors. More specifically, the fuel injectors include a first set of fuel injectors 21 which are fluidly coupled to a first fuel inlet plenum 25, and a second set of fluid injectors 23, which are fluidly coupled to a second fuel inlet plenum 27. In the exemplary embodiment shown in the drawings the first set of fluid injectors includes two fluid injectors 21 and the second set of fluid injectors includes two fluid injectors 23.

In the embodiment shown in the attached drawing, the fuel injectors 21 are arranged side-by-side on a plane O1 (see FIGS. 3, 4) which is orthogonal to the axis X-X of the stem 19. Similarly, injectors 23 are arranged side-by-side on a plane O2, which is parallel to the plane O1. More specifically, each fuel injector 21 has an injector axis 21A lying on plane O1, while each fuel injector 23 has an injector axis 23A lying on plane O2, see also FIGS. 6, 6A. The axis 21A of each fuel injector 21 of the first set of fuel injectors and the axis 23A of a corresponding fuel injector 23 of the second set of fuel injectors lie on a plane V1 or V2, orthogonal to planes O1 and O2. Correspondingly the first fuel inlet plenum 25 and the second fuel inlet plenum 27 are placed one on top of the other in the direction of extension (direction X-X) of the stem 19.

Each fuel injector 21 includes a centerbody 31 extending along the longitudinal axis 21A of the respective fuel injector 21, i.e., parallel to the direction Y-Y. Each centerbody 31 extends from the first fuel inlet plenum 25 towards a distal end 31A of the centerbody. Each centerbody 31 is surrounded by an outer sleeve 33, which can be coaxial to the respective centerbody 31. In some embodiments, the centerbody 31 and the outer sleeve 33 are non-coaxial but still arranged one inside the other. Irrespective of whether the centerbody 31 and the outer sleeve 33 are coaxial or non-coaxial, an annular premix chamber 35 forms therebetween, see in particular FIG. 4.

Each outer sleeve 33 is provided with at least one air inlet port 34, and preferably with a plurality of air inlet ports 34, which extend through the outer sleeve 33, i.e., through the wall forming the outer sleeve 33, from the exterior of the outer sleeve 33 to the annular premix chamber 35. Several air inlet ports 34 can be provided, each with its own inclination with respect to the axis of the centerbody 31. While in the attached drawings the air inlet ports 34 have an axial orientation, which is substantially orthogonal to the axis of the centerbody, in other embodiments the air inlet ports may be oriented differently, with a constant inclination different from 90° with respect to the axial direction, or even with an inclination that can vary from one air inlet port to the other, for instance in order to provide an air swirl in the premix chamber. For instance, the air inlet ports 34 with the same inclination may be grouped and different groups of air inlet ports 34 with different inclinations may be distributed in various regions of the outer sleeve 33.

Similarly, each fuel injector 23 includes a centerbody 37 extending along the longitudinal axis 23A of the respective fuel injector 23, i.e., parallel to the direction Y-Y. Each centerbody 37 extends from the second fuel inlet plenum 27 towards a distal end 37A of the centerbody. Each centerbody 37 is surrounded by an outer sleeve 39, which can be coaxial to the respective centerbody 37. In some embodiments, the centerbody 37 and the outer sleeve 39 are non-coaxial but still arranged one inside the other. Irrespective of whether the centerbody 37 and the outer sleeve 39 are coaxial or non-coaxial, an annular premix chamber 41 forms therebetween, see in particular FIG. 4.

Each outer sleeve 39 is provided with at least one air inlet port 40, and preferably with a plurality of air inlet ports 40, which extend through the outer sleeve 39, i.e., through the wall forming the outer sleeve 39, from the exterior of the outer sleeve 39 to the annular premix chamber 41. As mentioned above in connection with the air inlet ports 34, also the air inlet ports 40 may have a different inclination, for instance, they can be non-orthogonal to the axis of the centerbody, and may have inclinations which vary from one air inlet port to the other.

Each outer sleeve 33, 39 extends from a lower portion 19B of the stem 19 to a front wall 45 which mechanically connects the distal ends of all outer sleeves 33, 39 to one another. The front wall 45 has a front surface 45A which, when the fuel nozzle 17 is mounted in the combustor, faces the interior of the combustion chamber 11. The front wall 45 further includes a side surface 45B, which forms an edge surrounding the front wall. The edge may include two parallel straight edge portions, which are parallel to the direction X-X, i.e., substantially parallel to the stem 19. The straight edge portions allow a plurality of fuel nozzles 17 to be placed side-by side around the annular extension of the combustion chamber 11, thus closing the combustion chamber 11. With this configuration, a large number of adjacent fuel injectors can be arranged in a small space at the upstream end of the combustion chamber 11 around the axis A-A thereof.

In embodiments disclosed herein, each centerbody 31 of the fuel injectors 21 includes at least one fuel conduit 51, which is in fluid communication with the first fuel inlet plenum 25. In the embodiment shown in the attached drawings, a plurality of fuel conduits 51 are arranged around the longitudinal axis of each centerbody 31. The fuel conduits 51 may be oriented with different inclinations over the axis of the centerbody. As mentioned in connection with the air inlet ports 34, also the fuel conduits 51 may be grouped in different groups of conduits, wherein the fuel conduits of each group have the same inclination and the inclination can differ from one group to another.

In use, fuel is delivered from the first fuel inlet plenum 23 through the fuel conduits 51 in the annular premix chamber 35, where fuel is mixed with air flowing into the premix chamber 35 through the air inlet ports 34 and forms an air-fuel mixture, which is delivered to the combustion chamber 11 and combusted therein.

Similarly, each centerbody 37 of the fuel injectors 23 includes at least one fuel conduit 53, which is in fluid communication with the second fuel inlet plenum 27. In the embodiment shown in the attached drawings, a plurality of fuel conduits 53 are arranged around the longitudinal axis of each centerbody 37. Fuel conduits 53 with different inclinations can be used as outlined above in connection with centerbodies 31.

In use, fuel is delivered from the second fuel inlet plenum 25 through the fuel conduits 53 in the annular premix chamber 41, where fuel is mixed with air flowing into the premix chamber 41 through the air inlet ports 40 and forms an air-fuel mixture, which is delivered to the combustion chamber 11 and combusted therein.

In some embodiments, each distal end 31A, 37A of the centerbodies 31, 37 projects beyond the front surface 45A of the front wall 45 towards the interior of the combustion chamber 11. In other embodiments, however, the centerbodies 31, 37 can be shorter such as not to project from the front surface 45A of the front wall 45.

In some embodiments, the distal ends 31A, 37A of each centerbody 31, 37 can be convex, e.g. hemi-spherical or in the form of an ogive. In other embodiments, the distal ends 31A 37A of the centerbodies 31, 37 can be shaped differently, i.e., they could be flat, or may be concave.

The front wall 45 has a plurality of apertures 45C, one for each fuel injector 21, 23. Since in the illustrated embodiment the centerbodies 31, 37 have distal ends 31A, 37A projecting beyond the front wall 45A, each aperture 45C forms, with the respective centerbody 31, 37, a circular or annular port, through which, in use, the air-fuel mixture formed in the respective premix chamber 35 and 41 flows into the combustion chamber 11.

In some embodiments, the fuel nozzle includes a third fuel inlet plenum 55. In embodiments, the third fuel inlet plenum 55 is housed in the front wall 45. The third fuel inlet plenum 55 will be referred to as pilot plenum.

As best shown in FIGS. 5 and 6A, the pilot plenum 55 has an elongate shape and extends in a direction parallel to the axis X-X of the stem 19. The pilot plenum is therefore arranged along a median plane M-M of the stem 19. The fuel nozzle 17 comprises at least one, and preferably a plurality of fuel ports 57, which are fluidly coupled to the pilot plenum 55, see e.g. FIG. 5, and end on the front surface 45A of the front wall 45. Each fuel port 57 extends from the pilot plenum 55 to the front surface 45A of the front wall 45, such that, when the fuel nozzle 17 is mounted in the combustor 7 of the gas turbine engine, fuel can flow from the pilot plenum 53 into the combustion chamber 11.

The first fuel inlet plenum 25 is fluidly coupled to a source of fuel, not shown, through a first fuel feed channel 61, which extends from an inlet end 61A, located at the proximal end 19A of the stem 19, to the first fuel inlet plenum 25. The second fuel inlet plenum 27 is fluidly coupled to the source of fuel through a second fuel feed channel 63, which extends from an inlet end 63A, located at the proximal end 19A of the stem 19, to the second fuel inlet plenum 27. Finally, the pilot plenum 55 is fluidly coupled to the source of fuel through a third channel 65, which will be referred herein as a third fuel feed channel in connection with this embodiment. The third fuel feed channel 65 extends from an inlet end 65A, located at the proximal end 19A of the stem 19, to the pilot plenum 55. The amount of fuel delivered to the fuel inlet plenums may be adjusted individually for each inlet plenum by means of suitable control devices, such as controlled valves or the like, not shown. The fuel flowrate in each fuel inlet plenum can thus be adapted to the operating condition of the gas turbine engine.

The first fuel feed channel 61, the second fuel feed channel 63 and the third fuel feed channel 65 extend along the stem 19 and change shape and mutual position along their development, from the respective inlet ends 61A, 63A, 65A to the respective fuel inlet plenums 25, 27 and 55. The shape of each fuel feed channel 61, 63, 65 can be best appreciated from the sequence of axonometric sectional views of FIGS. 7, 8 and 9 taken along planes orthogonal to the axis X-X of the stem 19, as well as from the sequence of axonometric sectional views of FIGS. 11, 12 and 13 taken along planes parallel to axis X-X and orthogonal to axis Y-Y, as well as from the cross-sectional view of FIG. 10A.

At the proximal end 19A of the stem 19 the first fuel feed channel 61, the second fuel feed channel 63 and the third fuel feed channel 65 are arranged at the vertexes, i.e., at the corners of a triangle. Specifically, in the exemplary embodiment shown in the drawings, the first fuel feed channel 61 is arranged near an outer enveloping wall 69, which forms the outer skin of the stem 19 and within which the first fuel feed channel 61, the second fuel feed channel 63 and the third fuel feed channel 65 are enveloped.

The first fuel inlet channel 61 can be partly formed by the enveloping wall 69. The second fuel feed channel 63 can be connected to the enveloping wall 69 by a septum 71 and the third fuel feed channel 65 can be connected to the enveloping wall 69 by a septum 73.

Moreover, in some embodiments, the first fuel feed channel 61 can be connected to one or both the second fuel feed channel 63 and the third fuel feed channel 65. The first fuel feed channel 61 is mechanically coupled to the second fuel feed channel 63 by a septum 75 and is further mechanically coupled to the third fuel feed channel 65 by a further septum 77. The septa 75, 77 form two sides of the triangle, at the vertexes whereof the inlet ends 61A, 63A and 65A are positioned. Along the axial development of the stem 19 the shape and position of the septa change as a conse-quence of the changes in shape and position of the three fuel feed channels 61, 63, 65.

With this arrangement, the first fuel feed channel 61, the second fuel feed channel 63 and the third fuel feed channel 65 are rigidly coupled to one another and to the outer enveloping wall 69. The structure is rigid and can withstand mechanical stresses. At the same time, the septa 71, 73, 75, 77 and the outer enveloping wall 69, as well as the tubular structure of each fuel feed channel 61, 63, 65 are sufficiently thin to compensate for thermal expansions and contractions. Thermally induced stresses are thus reduced, which helps increasing the lifetime of the fuel nozzle 17.

Moving from the proximal end 19A towards the lower portion 19B of the stem 19, the shape and position of the first fuel feed channel 61, second fuel feed channel 6 and third fuel feed channel 65 change gradually, both with regard to the cross-sectional shape as well as with regard to the position of each channel with respect to the others and with respect to the outer enveloping wall 69.

Figure 10A:
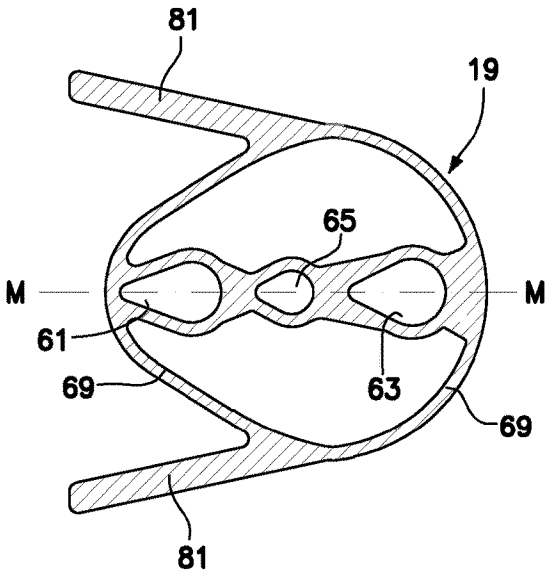
FIG. 10A is a sectional view according to line A-A of FIG. 10.
Figure 10:
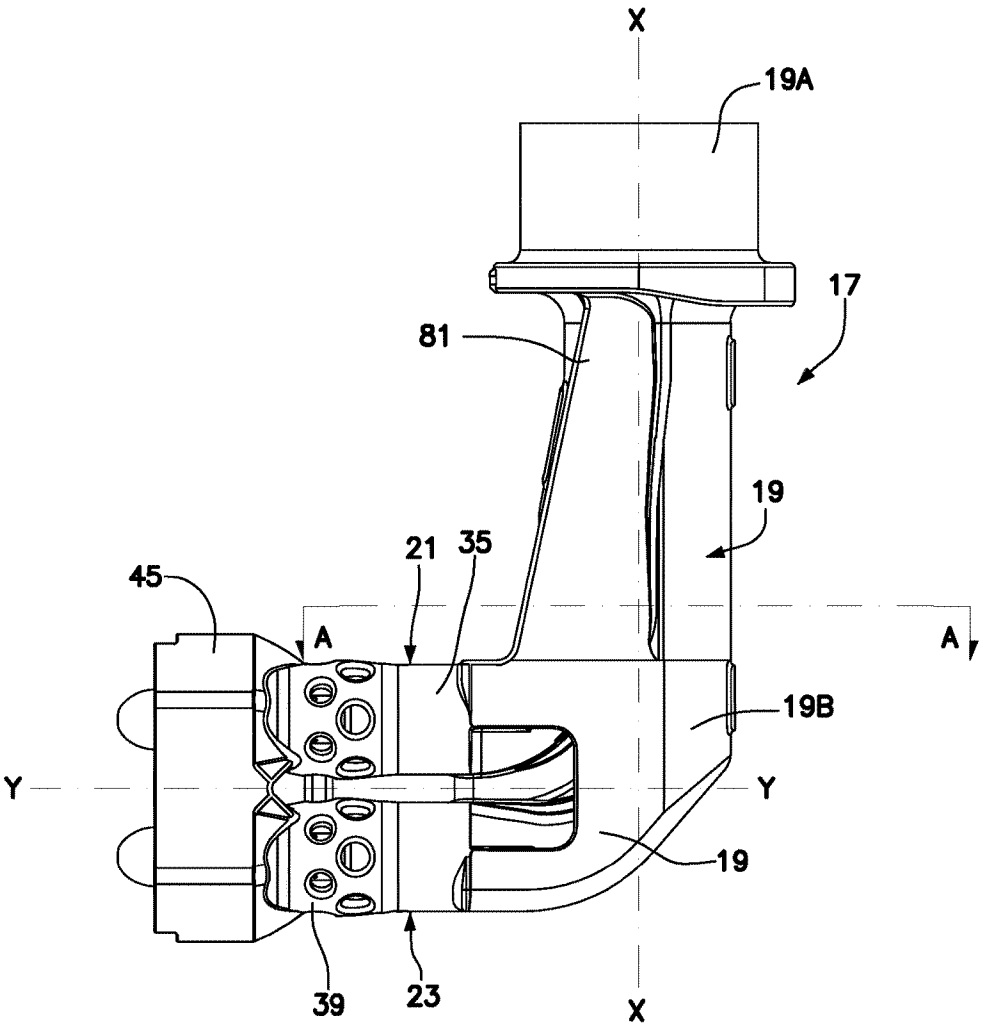
FIG. 10 is a side view of a fuel nozzle of the present disclosure.

More specifically, moving from the sectional plane of FIG. 7 to the sectional plane of FIG. 10A, the position of the first fuel feed channel 61 remains substantially unchanged, but the cross-sectional shape thereof changes from round to drop-shaped and the sectional area increases. The position of the second fuel feed channel 63 moves from the position of FIG. 7, at the vertex of the triangle, to a position which is aligned with the first fuel feed channel 61 on a median plane M-M (see FIG. 10A) of the stem 19. The median plane M-M is a plane containing the axis X-X of the stem 19 and parallel to the axes of the fuel injectors (i.e., parallel to direction Y-Y). The third fuel feed channel 65 moves from the vertex of the triangle at the proximal end 19A of the stem 19 to a position intermediate between the first fuel feed channel 61 and with the second fuel feed channel 63, and aligned therewith on the median plane M-M, see FIG. 10A.

In the sectional view of FIG. 10A the three fuel feed channels 61, 63, 65 are still connected to one another and to the outer enveloping wall 69, but are now aligned on the median plane M-M rather than at the vertexes of a triangle as in FIGS. 4 and 7.

From the position of FIG. 10A the first fuel feed channel 61, the second fuel feed channel 63 and the third fuel feed channel each bends towards the respective first fuel inlet plenum 25, second fuel inlet plenum 27 and pilot plenum 55.

More specifically, the cross section of the first fuel inlet duct 61 expands until forming the first fuel inlet plenum 25 (FIG. 5). The second fuel feed channel 65 extends under the first fuel inlet plenum 25 towards the bottom of the fuel nozzle 17, where the second fuel feed channel 65 expands until forming the second fuel inlet plenum 27. The third fuel feed channel 65 curves and finally merges into the pilot plenum 55.

To provide further stiffness to the stem 19, in some embodiments one or more stiffening ribs 81 can be foreseen along the stem 19. In the embodiment shown in the drawings, the outer enveloping wall 69 comprises a pair of stiffening ribs 81 extending from an outer surface of the outer enveloping wall 69 and symmetrically arranged with respect to the median plane M-M of the stem 19.

The full structure of the fuel nozzle 17 described so far, including the stem 19, the front wall 45 and the fuel injectors 21, 23, can be formed as a single monolithic component, for instance by additive manufacturing.

While in the embodiments described above the third channel 65 is used as a fuel feed channel, in other embodiments, a third channel 65 can be a generic service channel, i.e., can be used for a different purpose, such as to provide a connection between an instrument, gauge, sensor, or any other functional component or feature, in-stalled on the fuel nozzle and in the exterior of the combustion chamber, in which the fuel nozzle is mounted.

According to some embodiments, the third channel 65 can be used to house the wiring of a sensor, such as a flame detector, a hummering sensor adapted to detect pressure variations, or other instrumentality. In some embodiments, the third channel 65 can be used to provide a wire connection to a spark plug, for instance.

Exemplary embodiments have been disclosed above and illustrated in the accompanying drawings. It will be understood by those skilled in the art that various changes, omissions and additions may be made to that which is specifically disclosed herein without departing from the scope of the invention as defined in the following claims.

The invention claimed is:

1. A fuel nozzle for a gas turbine, comprising:

a single, monolithic body forming, a stem;

a first fuel feed channel extending inside the stem from an inlet end positioned at a proximal end of the stem to a first fuel inlet plenum;

a first set of fuel injectors fluidly coupled to the first fuel inlet plenum and projecting at an angle (a) from the stem;

a second fuel feed channel extending inside the stem, from an inlet end positioned at the proximal end of the stem to a second fuel inlet plenum; and a second set of fuel injectors fluidly coupled to the second fuel inlet plenum and projecting at an angle (a) from the stem, wherein the first fuel feed channel and the second fuel feed channel have a non-circular cross-section, wherein each fuel injector comprises:

a centerbody extending along a longitudinal axis from the respective fuel inlet plenum to a distal end of the centerbody, an outer sleeve surrounding the centerbody and extending along the axis of the centerbody, an annular premix chamber between each outer sleeve and the respective centerbody, an air inlet port extending through each outer sleeve, and a fuel conduit in each centerbody in fluid communication with the fuel inlet plenum and the annular premix chamber.

2. The fuel nozzle of claim 1, wherein the single monolithic body is manufactured by additive manufacturing.

3. The fuel nozzle of claim 1, wherein the first fuel inlet plenum and the second fuel inlet plenum are placed one after the other in a direction of extension of the stem.

4. The fuel nozzle of claim 1, further comprising:
a front wall disposed on the single monolithic body,
wherein each outer sleeve extends from the stem through the front wall.

5. The fuel nozzle of claim 4, wherein the front wall has a peripheral edge that includes two straight parallel edge portions extending parallel to the stem.

6. The fuel nozzle of claim 4, further comprising:
a third fuel feed channel extending inside the stem from an inlet end at the proximal end of the stem.

7. The fuel nozzle of claim 6, further comprising:
a third fuel inlet plenum formed in the front wall,
wherein the third fuel feed channel has an outlet end fluidly coupled to the third fuel inlet plenum, and
wherein the third channel is adapted to house a wiring to a functional component associated to the fuel nozzle.

8. The fuel nozzle of claim 7, further comprising:
a fuel port fluidly coupled to the third fuel inlet plenum and surfacing on the outer surface of the front wall.

9. The fuel nozzle of claim 7, wherein the pilot third fuel inlet plenum extends along a median plane of the stem between a first pair of fuel injectors and a second pair of fuel injectors,
wherein the first pair of fuel injectors comprises one fuel injector of the first set of fuel injectors fluidly coupled to the first fuel inlet plenum and one fuel injector of the second set of fuel injectors fluidly coupled to the second fuel inlet plenum, and
wherein the second pair of fuel injectors comprises another fuel injector of the first set of fuel injectors fluidly coupled to the first fuel inlet plenum and another fuel injector of the second set of fuel injectors fluidly coupled to the second fuel inlet plenum.

10. The fuel nozzle of claim 6, wherein the inlet end of the first fuel feed channel, the inlet end of the second fuel feed channel, and the inlet end of the third channel are positioned at the vertexes of a triangle, and
wherein in a position intermediate the inlet end and the outlet end, the first fuel feed channel, the second fuel feed channel, and the third channel are substantially coplanar on a median plane of the stem.

11. The fuel nozzle of claim 10, wherein on the median plane the third channel is arranged between the first fuel feed channel and the second fuel feed channel.

12. The fuel nozzle of claim 6, wherein the single monolithic body comprises an outer enveloping wall enclosing the first fuel feed channel, the second fuel feed channel, and the third channel.

13. The fuel nozzle of claim 1, wherein the single monolithic body comprises an outer enveloping wall enclosing the first fuel feed channel and the second fuel feed channel.

14. The fuel nozzle of claim 13, wherein the first fuel feed channel and the second fuel feed channel are mechanically coupled to one another and to the outer enveloping wall along at least a portion of a longitudinal extension thereof.

15. The fuel nozzle of claim 14, wherein one of the first fuel feed channel and the second fuel feed channel is at least partly formed by the outer enveloping wall.

16. The fuel nozzle of claim 15, wherein the one of the first fuel feed channel and the second fuel feed channel is mechanically coupled to the other of the first fuel feed channel by respective coupling septa extending along at least a portion of a longitudinal extension of the first fuel feed channel and the second fuel feed channel.

17. The fuel nozzle of claim 13, wherein the outer enveloping wall comprises,
at least one stiffening rib extending from an outer surface of the outer enveloping wall, and
a pair of stiffening ribs extending from the outer surface of the outer enveloping wall and symmetrically arranged with respect to a median plane of the stem.

18. The fuel nozzle of claim 1, wherein the fuel injectors extend at right angle to the stem.

19. A gas turbine engine comprising:
an air compressor;
a turbine wheel; and
a combustion chamber comprising a plurality of fuel nozzles according to claim 1, arranged with the fuel injectors facing an interior of the combustion chamber.

20. A fuel nozzle for a gas turbine, comprising:
a single, monolithic body having a stem portion with an inlet end, an injector portion extending from the stem portion at an angle, and a front wall disposed at an end of the injector portion;
a first fuel feed channel extending inside the stem portion from the inlet end to a first fuel inlet plenum;
a second fuel feed channel extending inside the stem portion from the inlet end to a second fuel inlet plenum;
a third fuel feed channel extending inside the stem portion from the inlet end to a third fuel inlet plenum formed in the front wall;
a fuel port fluidly coupled to the third fuel inlet plenum; and
fuel injectors disposed in the injector portion, the fuel injectors comprising:
a centerbody extending along a longitudinal axis from the respective fuel inlet plenum to a distal end of the centerbody,
an outer sleeve surrounding the centerbody and extending along the axis of the centerbody,
an annular premix chamber between each outer sleeve and the respective centerbody,
an air inlet port extending through each outer sleeve, and
a fuel conduit in each centerbody in fluid communication with the respective fuel inlet plenum and the annular premix chamber,
wherein the fuel injectors comprise a first fuel injector fluidly coupled to the first fuel inlet plenum and a second fuel injector fluidly coupled to the second fuel inlet plenum.

* * * * *